US007824201B2

(12) United States Patent
Eckhart

(10) Patent No.: US 7,824,201 B2
(45) Date of Patent: Nov. 2, 2010

(54) SWITCH ACTUATED NORMALLING JACK FOR PATCHBAYS

(75) Inventor: Andrew Karl Eckhart, Hoffman Estates, IL (US)

(73) Assignee: Switchcraft, Inc., Chicago, IL (US)

( * ) Notice: Subject to any disclaimer, the term of this patent is extended or adjusted under 35 U.S.C. 154(b) by 1011 days.

(21) Appl. No.: 10/863,322

(22) Filed: Jun. 8, 2004

(65) Prior Publication Data

US 2004/0224547 A1 Nov. 11, 2004

Related U.S. Application Data

(63) Continuation of application No. 10/264,744, filed on Oct. 4, 2002, now abandoned.

(51) Int. Cl.
*H01R 29/00* (2006.01)

(52) U.S. Cl. ..... 439/188; 439/668; 439/669

(58) Field of Classification Search ..... 439/188, 439/668, 669; 200/51.03, 51.04, 51.05, 51.06, 200/51.12
See application file for complete search history.

(56) References Cited

U.S. PATENT DOCUMENTS

| | | | | |
|---|---|---|---|---|
| 950,107 | A | 2/1910 | Larsson | |
| 2,427,464 | A * | 9/1947 | Lagin | 200/51.12 |
| 2,556,997 | A * | 6/1951 | Figueira | 200/51.17 |
| 4,356,360 | A * | 10/1982 | Volz | 200/11 R |
| 4,954,096 | A | 9/1990 | Frank | |
| 5,245,886 | A * | 9/1993 | Truesdell et al. | 74/501.6 |
| 5,885,096 | A | 3/1999 | Ogren | |
| 5,964,607 | A | 10/1999 | Finke et al. | |
| 6,116,961 | A | 9/2000 | Henneberger et al. | |
| 6,205,801 | B1 * | 3/2001 | Riglos et al. | 62/231 |
| 6,422,902 | B1 | 7/2002 | Ogren et al. | |

(Continued)

OTHER PUBLICATIONS

AVP Presents the Morph System at NAB 2000, Apr. 4, 2000, pp. 1-3.
Mini Shorti Quick-Switch™, ¼" Shorti Quick-Switch™ & ¼" Shorti Sleeve-Normalling. May 1, 2001.

(Continued)

*Primary Examiner*—Hae Moon Hyeon
(74) *Attorney, Agent, or Firm*—Schiff Hardin LLP

(57) ABSTRACT

A jack has first and second jack ports, first and second contacts, and a switch having a full, half, and no normal positions. In the full normal position, the switch couples the first and second contacts together when no plug is inserted into either the first or second jack port, and the switch conditions the jack so that, when a plug is inserted into either the first or second jack port, the coupling between the first and second contacts is broken, the first contact is coupled to the plug if the plug is in the first jack port, and the second contact is coupled to the plug if the plug is in the second jack port. In the half normal position, the jack operates in the same way except that, when a plug is inserted into the second jack port, the coupling between the first and second contacts is maintained. In the no normal position, there is no coupling between the first and second contacts whether or not a plug is inserted into either the first jack port or the second jack port.

36 Claims, 8 Drawing Sheets

U.S. PATENT DOCUMENTS

| | | | |
|---|---|---|---|
| 6,540,562 | B1 | 4/2003 | Baker et al. |
| 2002/0173188 | A1 | 11/2002 | Follingstad et al. |

OTHER PUBLICATIONS

Easy Patch, The Analog/Digital patch bays for today and tomorrow . . . from Neutrik®, 15 pages; Mar. 1999.

Product Guide 4.02, Designed Expressly for Broadcast, Production and Post-Production, Bittree, High-Performance Patching Systems, 13 pages; Apr. 2002.

Owner's Manual—Hosa Model PHB-265 Patch Bay, 1999 Hosa Technology, 8 pgs.

* cited by examiner

SWITCH ACTUATED NORMALLING JACK FOR PATCHBAYS

RELATED APPLICATIONS

This application is a continuation of U.S. patent application Ser. No. 10/264,744 filed on Oct. 4, 2002 now abandoned.

TECHNICAL FIELD OF THE INVENTION

The present invention relates to a dual, switch actuated, normalling jack.

BACKGROUND OF THE INVENTION

Audio jacks are used to interconnect various pieces of audio equipment. One such audio jack has first and second jack ports on the front of a jack housing, at least a first contact associated with the first jack port at the rear of the jack housing, and at least a second contact associated with the second jack port at the rear of the jack housing. The first contact can be referred to alternatively as the bottom contact, the second contact can be referred to alternatively as the top contact, the first jack port can be referred to alternatively as the bottom jack port, and the second jack port can be referred to alternatively as the top jack port.

Let it be assumed that the operation of this jack as described below in this paragraph is the normal operation of the jack. When no plug is inserted into either jack port, the first and second contacts are coupled together. However, when a plug is inserted into the first jack port, there is no coupling between the first and second contacts, and the first contact is instead coupled to the plug in the first jack port. Similarly, when a plug is inserted into the second jack port, there is no coupling between the first and second contacts, and the second contact is instead coupled to the plug in the second jack port.

Normalling of the jack refers to changing the operation of the jack. It is desirable for a jack to have full normal operation, half normal operation, and no normal operation. Full normal operation of the jack is described in the preceding paragraph.

During half normal operation of the jack, the first and second contacts are coupled together when no plug is inserted into either jack port. When a plug is inserted into the first jack port, the jack operates according to its full normal operation. That is, when a plug is inserted into the first jack port, there is no coupling between the first and second contacts, and the first contact is coupled to the plug in the first jack port. However, when a plug is inserted into the second jack port, the first and second contacts remain coupled together and the second contact is coupled to the plug in the second jack port. When plugs are inserted into both the first and second jack ports, the first contact and the first jack port are not coupled to the second contact and the second jack port so that there is no cross coupling. Accordingly, the first contact is coupled to the first jack port, and the second contact is coupled to the second jack port.

During no normal operation, no signals are routed between the first and second jack ports. Each jack port is isolated from the other. Signals may flow between the first contact and the plug in the first jack port and between the second contact and the plug in the second jack port. Signals may not flow between the first contact and the plug in the second jack port, between the second contact and the plug in the first jack port, between the first and second contacts, or between the first and second jack ports.

Various designs have allowed a jack to be normalled. For example, wiring between jack ports and external jumper pins have permitted removable jumpers to be used to change the normalling of jacks. Such wiring and jumpers have been used either behind the jacks on a patchbay panel, or in front of the jacks with some sort of covering. Removable jacks have also been used so that jumper wires or clips could be removed or repositioned to affect the normalling of the jack.

The present invention is directed to a jack that allows for the changing of its normalling without removing the jack from the panel, and without the use of external parts such as jumper wires or clips that can be lost or applied incorrectly. Instead, switching is provided to control normalling of a jack according to the present invention. The switching is internal to the jack.

SUMMARY OF THE INVENTION

In accordance with one aspect of the present invention, a jack comprises a housing supporting first and second jack ports, a first contact within the housing, a second contact within the housing, and a switch within the housing. The switch has a full normal position and a half normal position. In the full normal position, the switch couples the first and second contacts together when no plug is inserted into either the first jack port or the second jack port, and the switch conditions the jack so that, when a plug is inserted into the first jack port, the coupling between the first and second contacts is broken and the first contact is coupled to the first jack port, and so that, when a plug is inserted into the second jack port, the coupling between the first and second contacts is broken and the second contact is coupled to the second jack port. In the half normal position, the switch couples the first and second contacts together when no plug is inserted into either the first jack port or the second jack port, and the switch conditions the jack so that, when a plug is inserted into the first jack port, the coupling between the first and second contacts is broken and the first contact is coupled to the first jack port, and so that, when a plug is inserted into the second jack port, the coupling between the first and second contacts is maintained and the second contact is coupled to the second jack port.

In accordance with another aspect of the present invention, a jack comprises a housing supporting first and second jack ports, a first contact within the housing, a second contact within the housing, and a switch within the housing. The switch has a full normal position and a no normal position. In the full normal position, the switch couples the first and second contacts together when no plug is inserted into either the first jack port or the second jack port, and the switch conditions the jack so that, when a plug is inserted into the first jack port, the coupling between the first and second contacts is broken and the first contact is coupled to the first jack port, and so that, when a plug is inserted into the second jack port, the coupling between the first and second contacts is broken and the second contact is coupled to the second jack port. In the no normal position, the switch provides no coupling between the first and second contacts whether or not a plug is inserted into either the first jack port or the second jack port, and the switch conditions the jack so that, when a plug is inserted into the first jack port, the first contact is coupled to the first jack port, and so that, when a plug is inserted into the second jack port, the second contact is coupled to the second jack port.

In accordance with still another aspect of the present invention, a jack comprises a housing supporting first and second jack ports, a first contact within the housing, a second contact within the housing, and a switch within the housing. The switch has a half normal position and a no normal position. In the half normal position, the switch couples the first and second contacts together when no plug is inserted into either the first jack port or the second jack port, and the switch conditions the jack so that, when a plug is inserted into the first jack port, the coupling between the first and second contacts is broken and the first contact is coupled to the first jack port, and so that, when a plug is inserted into the second jack port, the coupling between the first and second contacts is maintained and the second contact is coupled to the second jack port. In the no normal position, the switch provides no coupling between the first and second contacts whether or not a plug is inserted into either the first jack port or the second jack port, and the switch conditions the jack so that, when a plug is inserted into the first jack port, the first contact is coupled to the first jack port, and so that, when a plug is inserted into the second jack port, the second contact is coupled to the second jack port.

In accordance with yet another aspect of the present invention, a jack comprises a housing supporting first and second jack ports, a first contact within the housing, a second contact within the housing, and a switch within the housing. The switch has a full normal position, a half normal position, and a no normal position. In the full normal position, the switch couples the first and second contacts together when no plug is inserted into either the first jack port or the second jack port, and the switch conditions the jack so that, when a plug is inserted into the first jack port, the coupling between the first and second contacts is broken and the first contact is coupled to the first jack port, and so that, when a plug is inserted into the second jack port, the coupling between the first and second contacts is broken and the second contact is coupled to the second jack port. In the half normal position, the switch couples the first and second contacts together when no plug is inserted into either the first jack port or the second jack port, and the switch conditions the jack so that, when a plug is inserted into the first jack port, the coupling between the first and second contacts is broken and the first contact is coupled to the first jack port, and so that, when a plug is inserted into the second jack port, the coupling between the first and second contacts is maintained and the second contact is coupled to the second jack port. In the no normal position, the switch provides no coupling between the first and second contacts whether or not a plug is inserted into either the first jack port or the second jack port, and the switch conditions the jack so that, when a plug is inserted into the first jack port, the first contact is coupled to the first jack port, and so that, when a plug is inserted into the second jack port, the second contact is coupled to the second jack port.

In accordance with a further aspect of the invention, a jack comprises a housing and rotary switch. The housing supports first and second jack ports and first and second contacts. The rotary switch is supported by the housing, and the rotary switch can be rotated between first and second different normal positions so as to control connections between the first and second jack ports and the first and second contacts and so as to control normalling of the jack.

In accordance with a still further aspect of the invention, a jack comprises a housing and a plurality of switches. The housing supports first and second jack ports, first and second contacts, and a plurality of switches. The plurality of switches can be operated concurrently to first and second different normal positions so as to control connections between the first and second jack ports and the first and second contacts and so as to control normalling of the jack.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
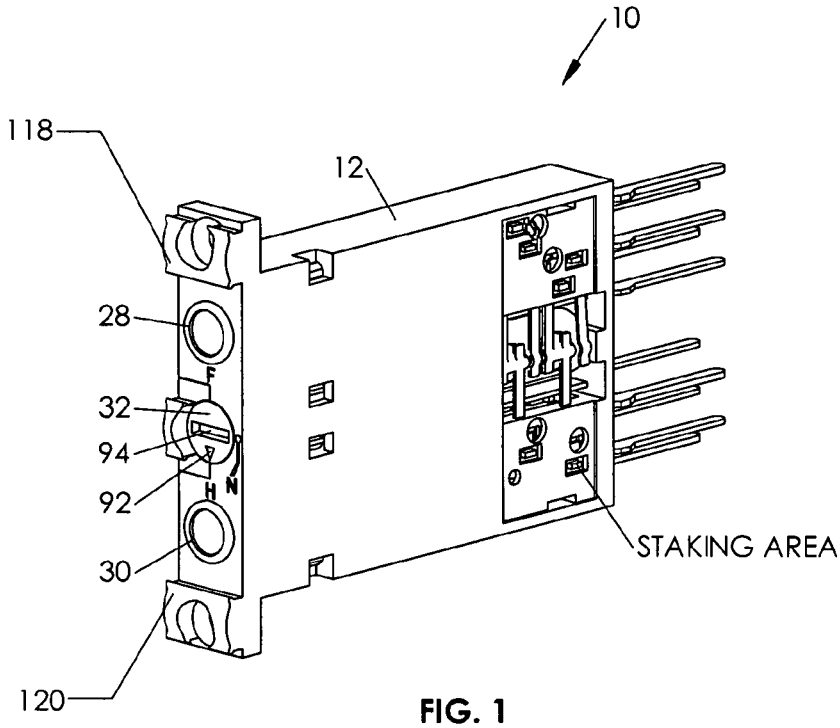
FIG. 1 is a first isometric view of the housing for the jack according to one embodiment of the present invention.
Figure 2:
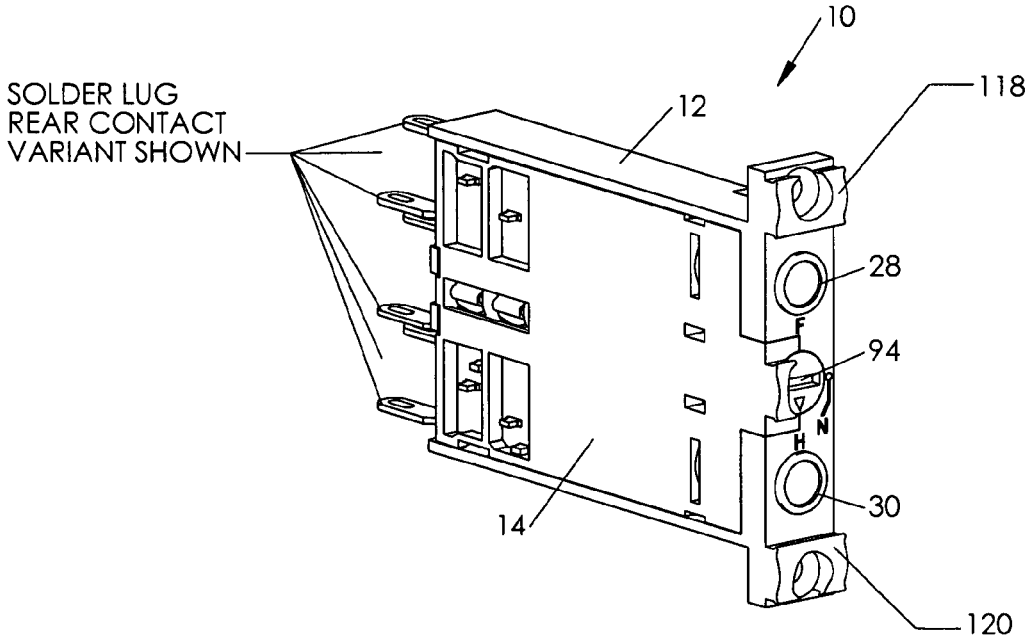
FIG. 2 is a second isometric view of the housing for the jack of FIG. 1.

As shown in FIGS. 1 and 2, a jack 10 according to the present invention includes a jack housing 12 and a cover 14. The jack housing 12 and the cover 14, for example, may be plastic such as 30% glass reinforced polyester. One such material is Valox 420SEO. The jack housing 12 and the cover 14 provide an electrically insulative enclosure for the internal parts of the jack 10 that are described below.

Switch spring contacts 16, 18, 20, 22, 24, and 26, better shown in FIGS. 7-9 and 11, are internally fixed, such as by molding, to the jack housing 12. Front openings of the jack housing 12 support jack ports 28 and 30 that are configured to receive plugs. The jack ports 28 and 30 as shown in FIGS. 3-5 and 13 of the drawings are collars in the jack housing 12. As shown in FIGS. 3-5 and 13, the jack housing 12 also supports a cam 32 for rotation in channels 34, 36, and 38. As is explained below, the cam 32 has three positions (full normal, half normal, and no normal).

As shown in FIGS. 3-5 and 13, the jack housing 12 further supports and separates tip spring contacts 40 and 42, ring spring contacts 44 and 46, normalling spring contacts 48, 50, 52, and 54, and sleeve spring contacts 56 and 58 in corresponding slots. Corresponding holes in walls 60, 62, 64, and 66 of the jack housing 12 are provided to receive the tip spring contacts 40 and 42, the ring spring contacts 44 and 46, the normalling spring contacts 48, 50, 52, and 54, and the sleeve spring contacts 56 and 58.

Also, holes in raised floors 68 and 70 of the jack housing 12 (FIG. 13) allow fixed connections between the switch spring contact 16 and the ring spring contact 44, between the switch spring contact 18 and the normalling spring contact 48, between the switch spring contact 20 and the tip spring contact 40, between the switch spring contact 22 and the normalling spring contact 50, between the switch spring contact 24 and the normalling spring contact 54, and between the switch spring contact 26 and the normalling spring contact 52. These connections may be seen in FIG. 11. Moreover, operation of the cam 32 makes and breaks coupling between the switch spring contacts 16, 18, 20, 22, 24, and 26.

Figure 3:
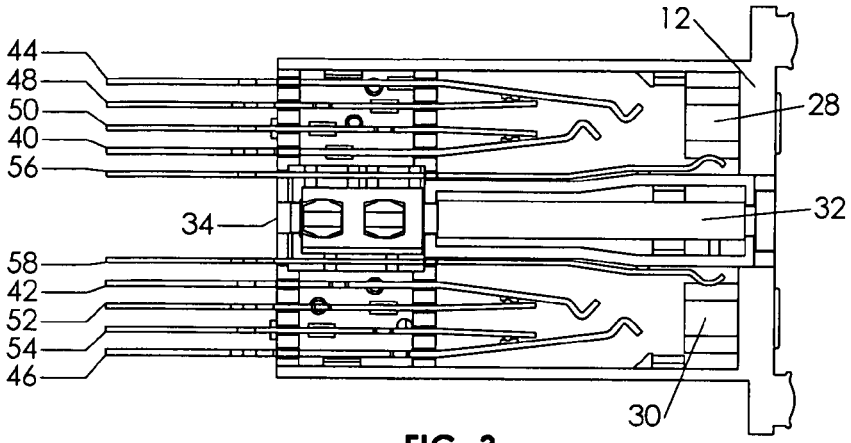
FIG. 3 shows the jack of FIGS. 1 and 2 with the cover of the jack housing removed.
Figure 4:
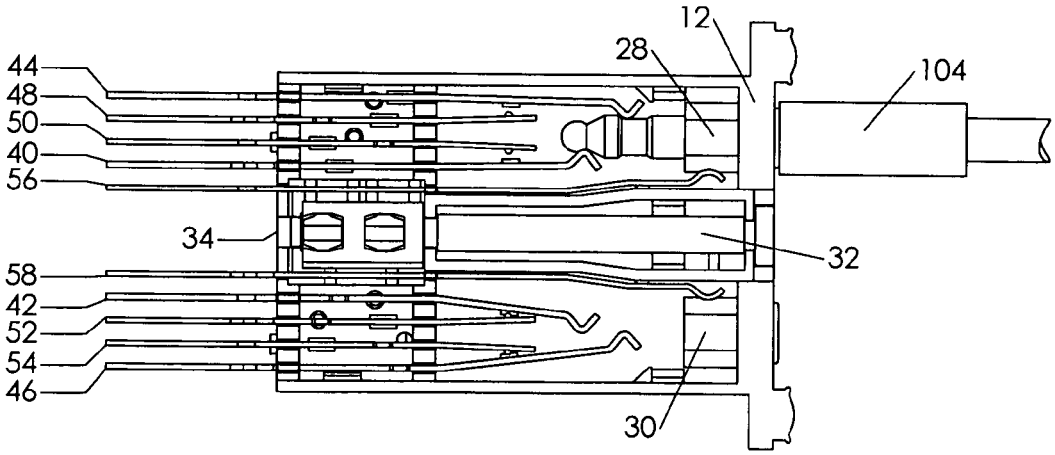
FIG. 4 shows the jack of FIG. 3 with a plug inserted into the first jack port.
Figure 5:
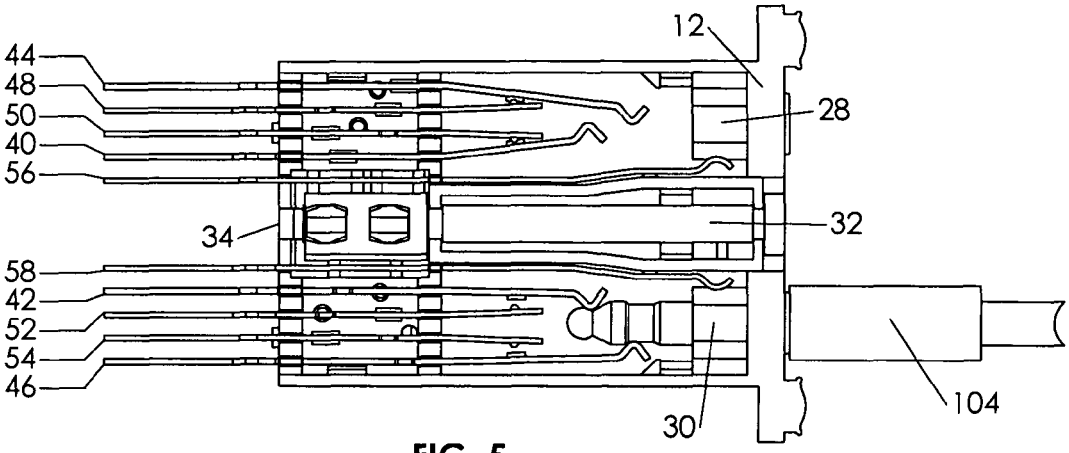
FIG. 5 shows the jack of FIG. 3 with a plug inserted into the second jack port.
Figure 6:
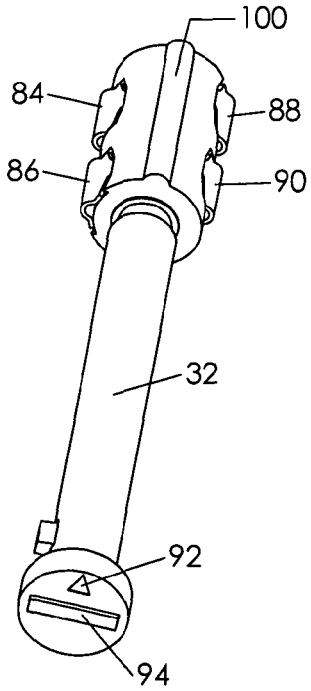
FIG. 6 shows a cam for use as a switch in the jack of FIGS. 1 and 2.
Figure 13:
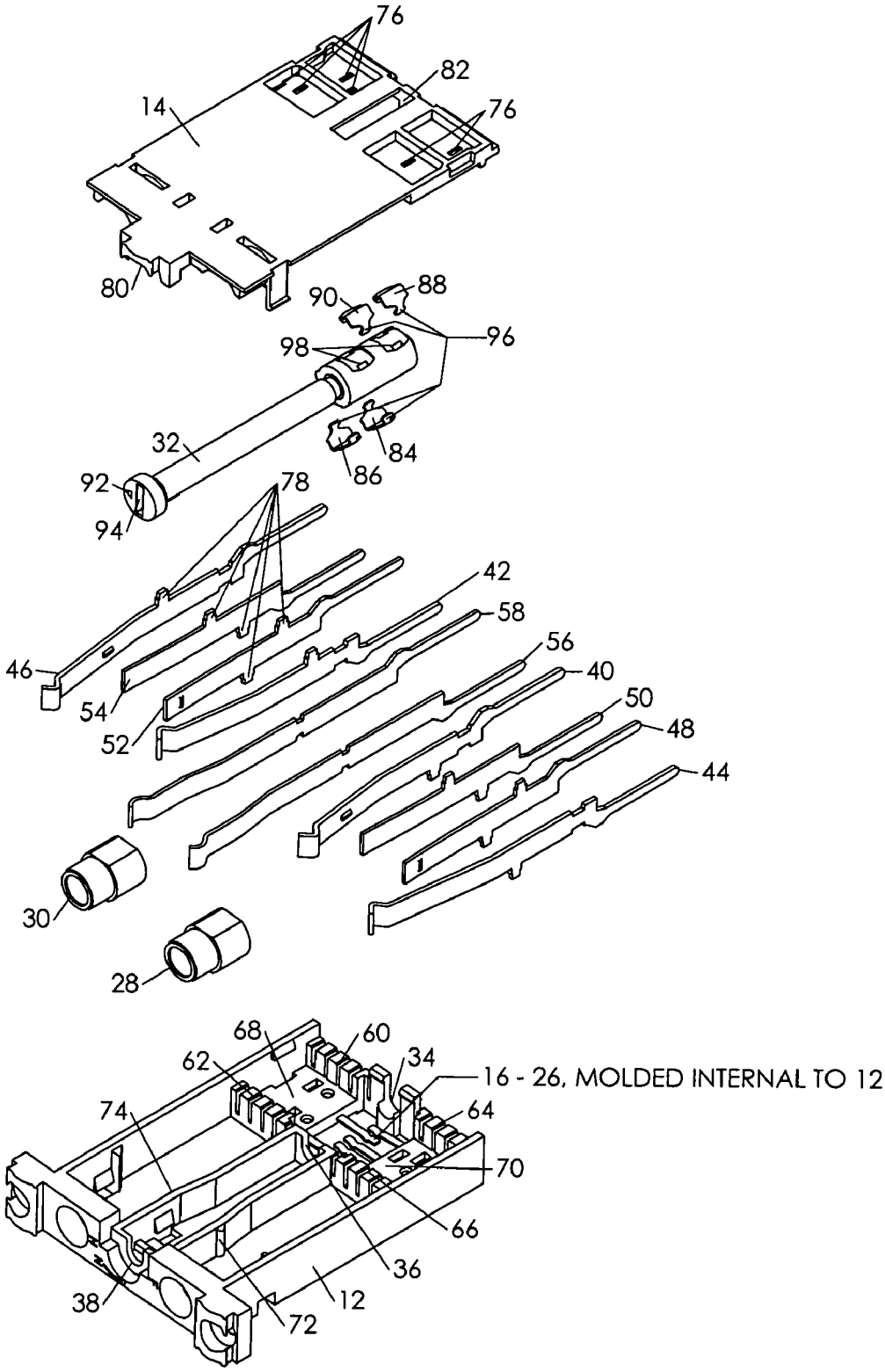
FIG. 13 is an exploded view of the jack according to the one embodiment of the present invention; and, FIGS. 14 and 15 illustrate a patchbay that can be used in combination with a jack.

As shown in FIGS. 3-5, the jack housing 12 holds the sleeve spring contact 56 in contact with the jack port 28, and holds the sleeve spring contact 58 in contact with the jack port 30. As shown in FIG. 13, bumps 72 and 74 are provided in the jack housing 12 in order to increase the pressure of the sleeve spring contacts 56 and 58 against the corresponding jack ports 28 and 30. Locking ledges on the jack housing 12 and locking tabs on the cover 14 may be provided to lock the cover 14 and the jack housing 12 together.

As shown in FIGS. 1 and 2, indicators such as "F", "H", and "N" are provided on the jack housing 12 and function as configuration setting locators to show the full normal, half normal, and no normal positions of the cam 32.

As shown in FIG. 13, the cover 14 may be provided with slots 76 to receive corresponding tabs 78 of the tip spring contacts 40 and 42, the ring spring contacts 44 and 46, and the normalling spring contacts 48, 50, 52, and 54 in order to assist in holding the tip spring contacts 40 and 42, the ring spring contacts 44 and 46, and the normalling spring contacts 48, 50, 52, and 54 in place. The cover 14 has supportive profiles in order to wedge the collars of the jack ports 28 and 30 in place and to hold these collars from being pushed out. For example, the cover 14 and the collars of the jack ports 28 and 30 may be provided with corresponding flats to prevent rotation of these collars in the hack housing 12. The cover 14 has channels such as channels 80 and 82 that cooperate with the channels 34, 36, and 38 in the jack housing 12 in order to support the cam 32 and to allow rotation of the cam 32.

The cam 32 may be a polycarbonate plastic such as Lexan 940. The cam 32 is an electrical insulator and supports and aligns electrically conductive cam surfaces 84, 86, 88, and 90 (FIGS. 6, 7, 8, 9, 12, and 13). The electrically conductive cam surfaces 84, 86, 88, and 90 may alternatively be referred to as bridging contacts. The cam 32 rotates the electrically conductive cam surfaces 84, 86, 88, and 90 into and out of engagement with the switch spring contacts 16, 18, 20, 22, 24, and 26 in the jack housing 12. The cam 32 has an arrow 92 (FIGS. 1, 2, 6, and 13) that cooperates with the indicators (such as "F", "H", and "N") on the jack housing 12 in order to show the three positions of the cam 32. The cam 32 also has a slot 94 (FIGS. 1, 2, 6, and 13) to allow a slotted tool (such as a flat head screw driver) to be used to rotate the cam 32 and to thereby set the configuration [full normal, half normal, or no-normal] of the jack 10 by rotating the electrically conductive cam surfaces 84, 86, 88, and 90 into the three positions shown in FIGS. 7, 8, and 9. However, mechanisms other than the slot 94 may be provided for rotating the cam 32.

The electrically conductive cam surfaces 84, 86, 88, and 90 may, for example, be silver plated brass in order to provide electrically conductive paths between corresponding combinations of the switch spring contacts, 16, 18, 20, 22, 24, and 26 in the full normal and half normal positions. The electrically conductive cam surfaces 84, 86, 88, and 90 have tangs 96 that cooperate with slots 98 on the cam 32 in order to provide a retention force to hold the electrically conductive cam surfaces 84, 86, 88, and 90 on the cam 32 (FIG. 13). The cam 32 has at least one ridge 100 (FIGS. 6 and 12) for the detent action mentioned below. Also, the ridge 100 fits in mating depressions in the switch spring contacts 16, 18, 20, 22, 24, and 26 in order to effectively prevent the cam 32 from rotating out of position until extra force is applied by way of the slot 94.

The tip spring contacts 40 and 42, for example, may be nickel silver, possibly plated with gold for better contact and conduction, and provide a conductive path to an inserted plug (FIGS. 4 and 5). Each of the tip spring contacts 40 and 42 has a contact area to contact a respective one of the normalling spring contacts 50 and 52 until a plug is inserted (FIG. 3). These contact areas can be flat or have a bump. A bump reduces the area of contact, but increases the contact pressure to thus lower the contact resistance. Alternatively, contact resistance can be lowered by using a precious metal (such as Gold or Palladium) for at least the contact areas between the tip spring contacts 40 and 42 and the corresponding normalling spring contacts 50 and 52.

The ring spring contacts 44 and 46, for example, may be nickel silver, possibly plated with gold for better contact and conduction, and provide a conductive path to an inserted plug (FIGS. 4 and 5). Each of the ring spring contacts 44 and 46 has a contact area to contact a respective one of the normalling spring contacts 48 and 54 until a plug is inserted (FIG. 3).

The normalling spring contacts 48, 50, 52, and 54, for example, may be nickel silver, possibly plated with gold for better contact and conduction, and do not engage a plug.

The sleeve spring contacts 56 and 58, for example, may be nickel silver and provide electrically conductive paths to the corresponding jack ports 28 and 30.

The collars of the jack ports 28 and 30, for example, may be brass, plated with nickel, gold, or other conductive protective metal. The sleeve spring contacts 56 and 58 are in electrical communication with inserted plugs through the jack ports 28 and 30. The jack ports 28 and 30 also provide stability to the plugs when the plugs are inserted into the jack 10 by acting as tight fitting cylinders around the shafts of the plugs.

The switch spring contacts 16, 18, 20, 22, 24, and 26, for example, may be nickel silver, plated with a highly conductive metal such as silver or gold. The switch spring contacts 16, 18, 20, 22, 24, and 26 in combination with the electrically conductive cam surfaces 84, 86, 88, and 90 on the cam 32 provide electrically conductive paths between certain combinations of the tip spring contacts 40 and 42, the ring spring contacts 44 and 46, and the normalling spring contacts 48, 50, 52, and 54. The switch spring contacts 16, 18, 20, 22, 24, and 26 may have punched out slots to fixedly receive tabs in the tip spring contacts 40 and 42, the ring spring contacts 44 and 46, and the normalling spring contacts 48, 50, 52, and 54.

Figure 12:
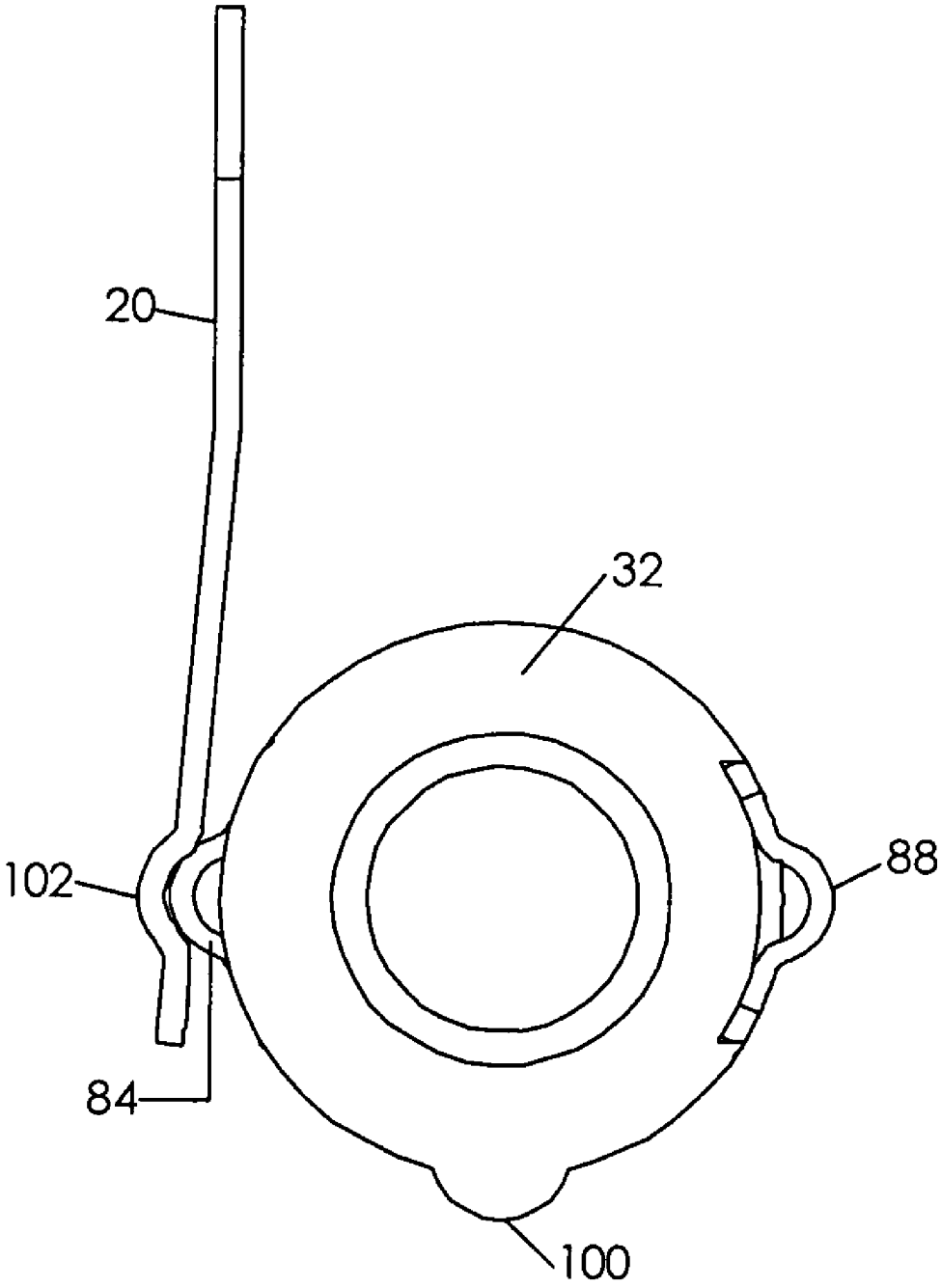
FIG. 12 illustrates the interaction between the cam and one of the spring contacts shown in FIG. 11.

As shown in FIG. 12, the switch spring contacts 16, 18, 20, 22, 24, and 26 are provided with profiles 102 that are formed to fit against the electrically conductive cam surfaces 84, 86, 88, and 90 and the bump 100 when the cam 32 is rotated into its full normal, half normal, and no normal positions of the cam 32 with respect to the switch spring contacts 16, 18, 20, 22, 24, and 26. The spring action of the switch spring contacts 16, 18, 20, 22, 24, and 26 holds the profiles 102 against the electrically conductive cam surfaces 84, 86, 88, and 90 and the bump 100, thus creating a "detent" action that resists rotation of the cam 32 until the cam 32 is forcibly rotated by the user. Alternatively, suitable detents may be provided between the cam 32 and the jack housing 12 in order to hold the cam 32 in each of its three positions.

Full Normal Operation—When the cam 32 is rotated so that the arrow 92 points to the "F" indicator, the jack 10 is in the full normal configuration. When the cam 32 is in this position, FIG. 8 shows that the electrically conductive cam surface 88 engages the switch spring contacts 22 and 26, and the electrically conductive cam surface 90 engages the switch spring contacts 18 and 24.

Figure 8:
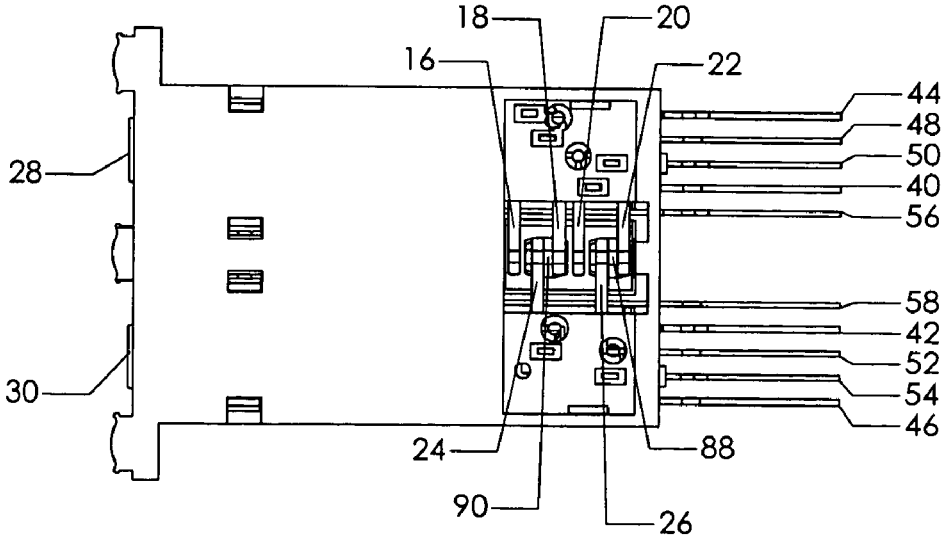
FIG. 8 is a frontal view of the side of the jack as shown in FIG. 1 and shows the cam of FIG. 6 in a full normal position.
Figure 11:
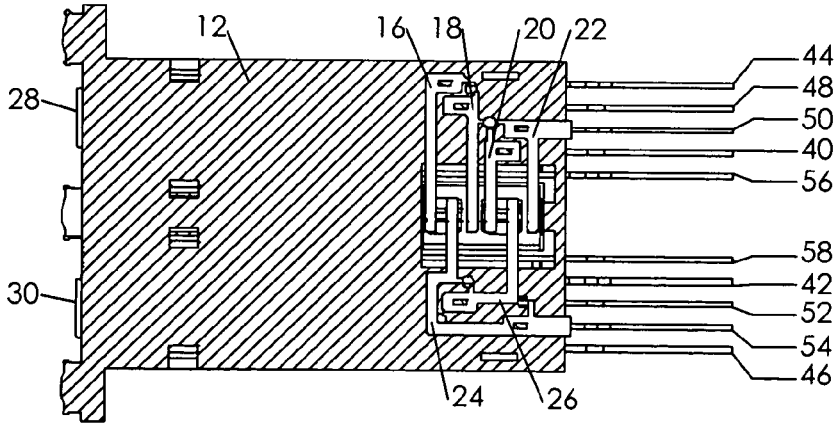
FIG. 11 is a cut-away of the jack as shown in FIGS. 7-9 to show the relationship between the switch spring contacts and the cam surfaces of the cam shown in FIG. 6.

As shown in FIGS. 3, 8, and 11, when no plug is inserted into the jack 10, a signal applied to the tip spring contact 40 is transferred to the tip spring contact 42 through the normalling spring contact 50, the switch spring contact 22, the electrically conductive cam surface 88, the switch spring contact 26, and the normalling spring contact 52 which is in contact with the tip spring contact 42.

The signal on the tip spring contact 40 is also transferred to the switch spring contact 20, but the switch spring contact 20 is not engaged by any of the electrically conductive cam surfaces 84, 86, 88, and 90. Thus, the switch spring contact 20 is effectively an open circuit. The signal on the tip spring contact 40 could be tapped at the normalling spring contacts 50 and 52, but only according to a non-standard use of the jack 10.

In a similar fashion, a signal applied to the ring spring contact 44 is transferred to the ring spring contact 46 through the normalling spring contact 48, the switch spring contact 18, the electrically conductive cam surface 90, the switch spring contact 24, and the normalling spring contact 54 which is in contact with the ring spring contact 46 as shown in FIG. 3. The signal on the ring spring contact 44 is also transferred to the switch spring contact 16, but the switch spring contact 16 is in an open circuit condition because it does not engage any of the electrically conductive cam surfaces 84, 86, 88, and 90.

Signals applied to the sleeve spring contacts 56 and 58 are transferred directly to the jack ports 28 and 30, respectively. However, because there is no plug inserted into the jack 10, the signals go nowhere and are essentially left open as non-terminated.

As shown in FIGS. 4, 8, and 11, when a plug 104 is inserted into the jack port 28, the tip spring contact 40 and the ring spring contact 44 are forced away from their respective normalling spring contacts 50 and 48, effectively eliminating any electrical contact between the tip spring contact 40 and the normalling spring contact 50 and between the ring spring contact 44 and the normalling spring contact 48. Because the only way for a signal to get from the tip spring contact 40 and the ring spring contact 44 to the electrically conductive cam surfaces 84, 86, 88, and 90 and then to the lower half of the jack 10 (e.g., the tip spring contact 42, the ring spring contact 46, and the normalling spring contacts 52 and 54) is through the normalling spring contacts 48 and 50 and the switch spring contacts 16, 18, 20, and 22, the lower half of the jack 10 is effectively isolated from the upper half of the jack 10.

Accordingly, the signal on the tip spring contact 40 is transferred only to the plug 104, the signal on the ring spring contact 44 is transferred only to the plug 104, and the signal on the sleeve spring contact 56 is transferred through the jack port 28 to the plug 104. Because insertion of the plug 104 into the jack port 28 interrupts the normal signal flow from top half of the jack 10 to the bottom half of the jack 10, the signal on the tip spring contact 40 is not transferred to the tip spring contact 42, and the signal on the ring spring contact 44 is not transferred to the ring spring contact 46.

When the plug 104 is inserted into the jack port 30 as shown in FIG. 5, the tip spring contact 42 and the ring spring contact 46 are forced away from their respective normalling spring contacts 52 and 54, effectively eliminating any electrical contact between the tip spring contact 42 and the normalling spring contact 52 and between the ring spring contact 46 and the normalling spring contact 54.

A signal applied to the tip spring contact 40 is transferred to the normalling spring contact 52 through the normalling spring contact 50, the switch spring contact 22, the electrically conductive cam surface 88, and the switch spring contact 26. However, because the normalling spring contact 52 is not in contact with the tip spring contact 42, the circuit between the tip spring contacts 40 and 42 is open and no signal flows.

Similarly, a signal on the ring spring contact 44 is transferred to the normalling spring contact 54 through the normalling spring contact 48, the switch spring contact 18, the electrically conductive cam surface 90, and the switch spring contact 24. However, because the normalling spring contact 54 is not in contact with the ring spring contact 46, the circuit between the ring spring contacts 44 and 46 is open and no signal flows.

Accordingly, inserting the plug 104 in the jack port 30 while the jack 10 is in the full normal configuration isolates the top and bottom halves of the jack 10 just as inserting the plug 104 in the jack port 28 does. The signals coming from the tip, ring, and sleeve of the plug 104 are the only signals seen on the tip spring contact 42, the ring spring contact 46, and the sleeve spring contact 58 of the jack 10.

When plugs are inserted into both the jack port 28 and the jack port 30, the jack 10 behaves just like it would with a single plug inserted in either of the jack ports 28 and 30, except that the signals on the upper contacts (i.e., the tip spring contact 40, the ring spring contact 44, and the sleeve spring contact 56) are coupled to the plug in the jack port 28, and except that the signals on the lower contacts (i.e., the tip spring contact 42, the ring spring contact 46, and the sleeve spring contact 58) are coupled to the plug in the jack port 30. Each half of the jack 10 behaves as a separate single jack with no dependence on the other half of the jack 10.

Half Normal Operation—When the cam 32 is rotated so that the arrow 92 points to the "H" indicator, the jack 10 is in the half normal configuration. As the cam 32 rotates to the half normal position, FIG. 7 shows that the electrically conductive cam surfaces 84, 86, 88, and 90 also rotate to a position where the electrically conductive cam surface 84 engages the switch spring contact 20 and the switch spring contact 26, and the electrically conductive cam surface 86 engages the switch spring contact 16 and the switch spring contact 24.

Figure 7:
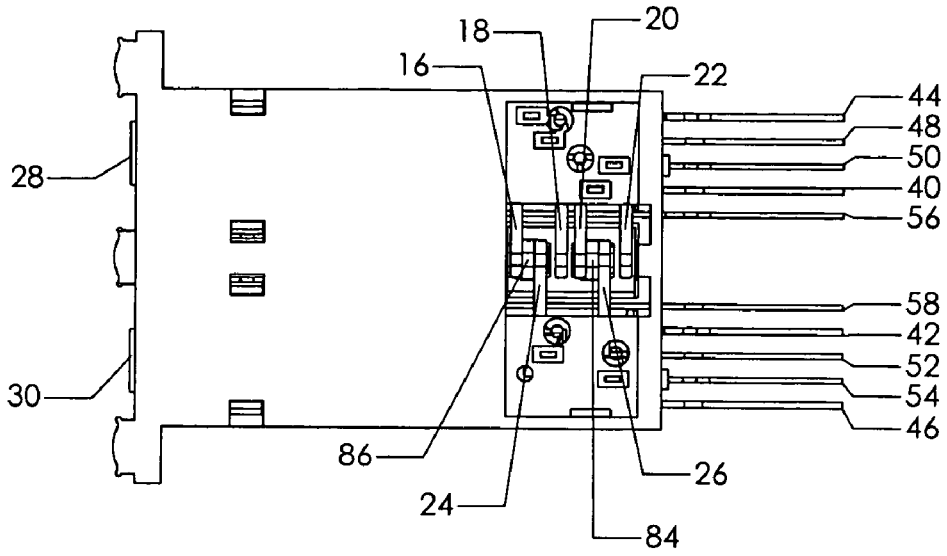
FIG. 7 is a frontal view of the side of the jack as shown in FIG. 1 and shows the cam of FIG. 6 in a half normal position.

As shown in FIGS. 3, 7, and 11, when no plug is inserted into the jack 10, a signal applied to the tip spring contact 40 is transferred to the tip spring contact 42 through the switch spring contact 20, the electrically conductive cam surface 84, the switch spring contact 26, and the normalling spring contact 52 which is in engagement with the tip spring contact 42.

Also, as shown in FIGS. 3 and 11, the signal applied to the tip spring contact 40 is transferred directly to the normalling spring contact 50 and to the switch spring contact 22. However, the switch spring contact 22 does not engage any of the electrically conductive cam surfaces 84, 86, 88, and 90 and, therefore, does not transfer the signal. The signal could be tapped at the normalling spring contacts 50 and 52, but for standard usage of the jack 10, all of the normalling spring contacts 48, 50, 52, and 54 are assumed to be unused. The normalling spring contacts 48, 50, 52, and 54 provide contacts only for non-standard use of the jack 10.

In a similar fashion, a signal on the ring spring contact 44 is transferred to the ring spring contact 46 through the switch spring contact 16, the electrically conductive cam surface 86, the switch spring contact 24, and the normalling spring contact 54 which, as shown in FIG. 3, is in contact with the ring spring contact 46.

The signal on the ring spring contact 44 is also transferred to the normalling spring contact 48 and then to the switch spring contact 18. However, the switch spring contact 18 does not engage any of the electrically conductive cam surfaces 84, 86, 88, and 90 and, therefore, does not transfer the signal.

The signal applied to the sleeve spring contact 56 is transferred to the jack port 28. However, because there is no plug inserted in to the jack 10, this signal goes nowhere and is essentially left open as a non-terminated or open circuit.

As shown in FIGS. 4, 7, and 11, when a plug 104 inserted into the jack port 28, the tip spring contact 40 and the ring spring contact 44 are forced away from their respective normalling spring contacts 48 and 50, effectively eliminating any electrical communication between the ring spring contact 44 and the normalling spring contact 48 and between the tip spring contact 40 and the normalling spring contact 50. Therefore, a signal applied to the tip spring contact 40 is transferred to the tip spring contact 42 through the switch spring contact 20, the electrically conductive cam surface 84, the switch spring contact 26, the normalling spring contact 52, and the tip spring contact 42 which, as shown in FIG. 4, is in contact with the normalling spring contact 52. Also, the signal on the tip spring contact 40 is transferred to the tip area of the inserted plug 104 due to the contact between the tip spring contact 40 and the plug 104 as shown in FIG. 4.

This operation effectively creates a "Y" junction, or split, where the signal gets sent in two directions: out the rear of the jack 10 through the tip spring contact 42 and out the front of the jack 10 through the plug 104 in the jack port 28.

Similarly, a signal applied to the ring spring contact 44 is transferred to the ring spring contact 46 through the switch spring contact 16, the electrically conductive cam surface 86, the switch spring contact 24, and the normalling spring contact 54 which, as shown in FIG. 4, is in contact with the ring spring contact 46. Also, the ring spring contact 44 also engages the plug 104, thus creating a "Y" junction.

The signal applied to the sleeve spring contact 56 is transferred through the jack port 28 to the plug 104. There is no communication of signals between the sleeve spring contacts 56 and 58.

As shown in FIGS. 5, 7, and 11, when the plug 104 is instead inserted into the jack port 30, the tip spring contact 42 and the ring spring contact 46 are forced away from their respective the normalling spring contacts 52 and 54, effectively eliminating any electrical engagement between the tip spring contact 42 and the normalling spring contact 52 and between the ring spring contact 46 and the normalling spring contact 54. A signal applied to the tip spring contact 40 is transferred to the normalling spring contact 52 through the switch spring contact 20, the electrically conductive cam surface 84, and the switch spring contact 26. However, because the normalling spring contact 52 is not in engagement with the tip spring contact 42 due to the plug 104, the signal between the tip spring contacts 40 and 42 is effectively interrupted. Any signal between the ring spring contacts 44 and 46 is also effectively interrupted.

Indeed, the only signals applied to the tip spring contact 42 and the ring spring contact 46 are those signals being sent into the jack 10 through the plug 104. The plug 104 also supplies a signal through the jack port 30 to the sleeve spring contact 58. In this mode, any signals from the upper half of the jack 10 as viewed in FIG. 5 are interrupted and are isolated from the lower half of the jack 10 so that the signals on the lower contacts (the tip spring contact 42 and the ring spring contact 46) of the jack 10 are independent of any signals on the upper half of the jack 10.

When a plug is inserted into both the jack ports 28 and 30, the jack 10 operates just like it did when the plug 104 is inserted only in the jack port 30, except that the signals applied to the tip spring contact 40, the ring spring contact 44, and the sleeve spring contact 56 are transferred directly to the plug inserted in the jack port 28. Because the tip spring contacts 40 and 42 and the ring spring contacts 44 and 46 are separated from their corresponding normalling spring contacts 48, 50, 52, and 54, no signal can be transferred from the tip spring contact 40, the ring spring contact 44, and the normalling spring contacts 48 and 50 in the upper half of the jack 10 to the tip spring contact 42, the ring spring contact 46, and the normalling spring contacts 52 and 54 in the lower half of the jack 10. Each half of the jack 10 is isolated and operates independently of the other half of the jack 10.

Figure 9:
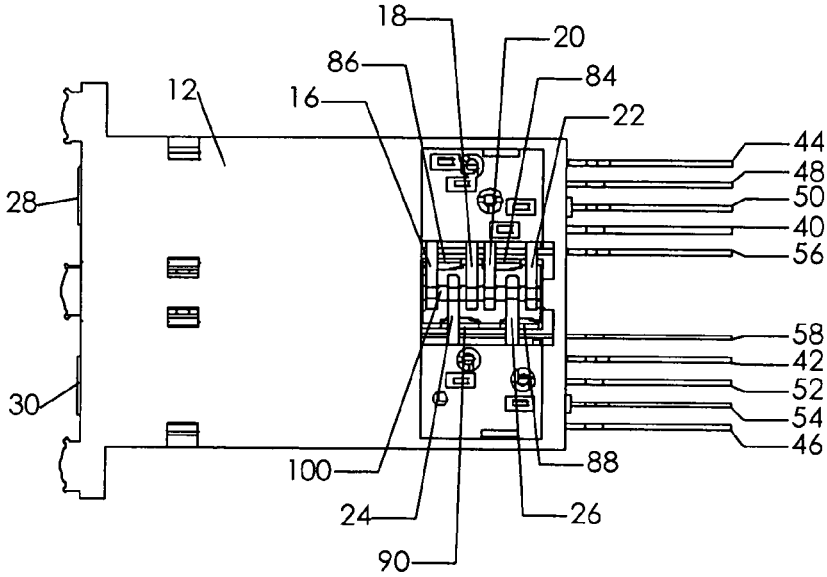
FIG. 9 is a frontal view of the side of the jack as shown in FIG. 1 and shows the cam of FIG. 6 in a no normal position.
Figure 10:
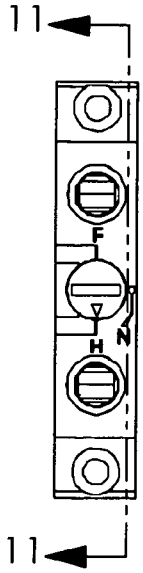
FIG. 10 is an end of the jack shown in FIG. 1.

No Normal Operation—When the cam 32 is rotated so that the arrow 92 points to the "N" indicator, the jack 10 is in the no normal configuration. This rotation of the cam 32, as shown in FIG. 9, means that none of the electrically conductive cam surfaces 84, 86, 88, and 90 engage any of the switch spring contacts 16, 18, 20, 22, 24, and 26. The ridge 100 on the cam 32 rests in the concave bump sections of the switch spring contacts 16, 18, 20, and 22 effectively holding the cam 32 in place as if it were in the Half or Full Normal position. However, due to the insulation effect of the cam 32, no signal can pass between any of the switch spring contacts 16, 18, 20, 22, 24, and 26. Accordingly, no signal can be transferred from one half of the jack 10 to the other half so that, in effect, two separate single jacks in the jack housing 12 are created.

The jack 10 can be used in manners other than the intended configurations. For example, the jack 10 can be installed upside down so that the upper and lower halves of the jacks are reversed. Accordingly, if the jack 10 were set to its Half Normal configuration, the jack 10 is in a Reverse Half Normal configuration where the "Y" split effect is realized with respect to the "bottom" half of the jack 10. Accordingly, the upside down use allows for the split to "Y" out from the "lower" jack port 28 instead of the "upper" jack port 28.

As another example, when the jack 10 is in the No Normal configuration, the normalling spring contacts 48, 50, 52, and 54 could be wired, using other external components, to change the normalling of the dual jack. Cabling could be used to attach the normalling spring contacts 48, 50, 52, and 54 to another terminal area where users could easily wire their own normalling configurations.

Non-standard configurations allow the user to connect cabling and wires to the rear of the jack 10 in a manner other than standard Tip, Ring, and Sleeve connections.

Figure 14:
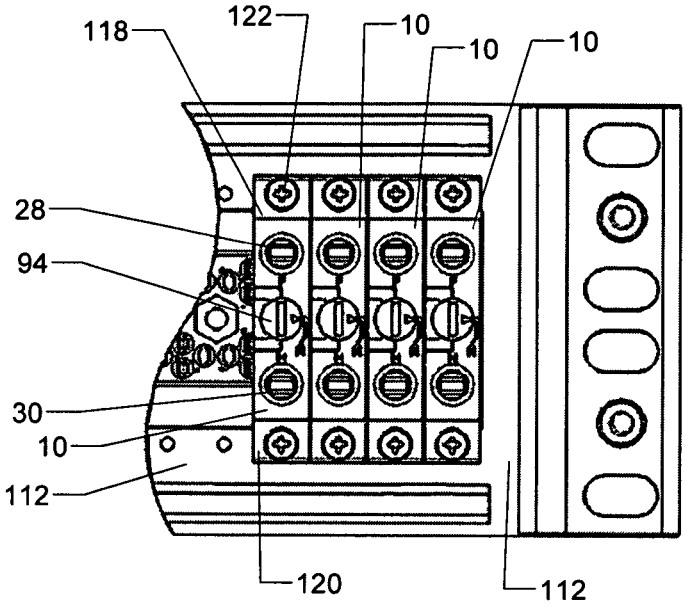
Figure 15:
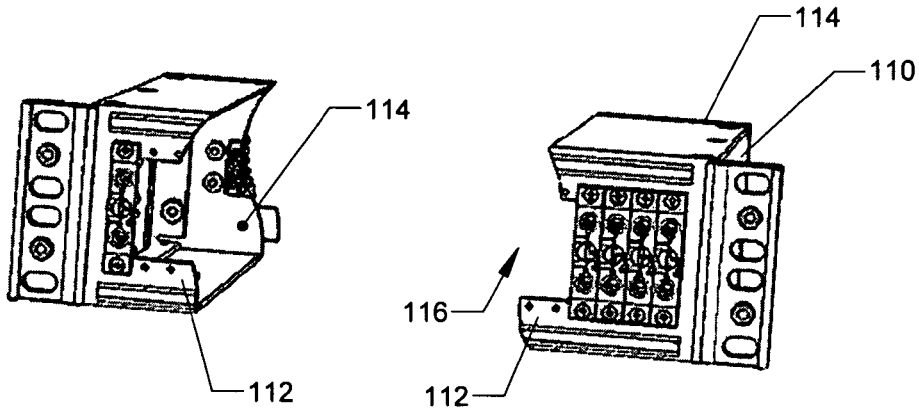

As shown in FIGS. 14 and 15, a patchbay 110, such as that shown by FIG. 22 of U.S. Pat. No. 4,770,639, is provided to receive the jack 10. The patchbay 110 has a front side 112, a rear side 114, and a front opening 116 through the front side 112. The jack 10 can be inserted through the front opening 116 in the patchbay 110, the jack 10 can be subsequently removed from the patchbay 110, the cam 32 on the jack 10 can be rotated to operate selected ones of the switches 16-26 and 84-90, and the jack 10 can be reinserted into the patchbay 110. Alternatively, the cam 32 can be rotated to operate selected ones of the switches 16-26 and 84-90 while the jack 10 remains in the patchbay 110. The jack 10 has flanges 118 and 120 with holes therethrough such that fastening devices 122 and 124 can be inserted through the flanges 118 and 120 to fasten the jack 10 to the patchbay 110. A plurality of the jacks 10 can be inserted into the patchbay 110 as shown in FIG. 14.

Certain modifications of the present invention have been described above. Other modifications will occur to those practicing in the art of the present invention. For example, the present invention can be applied to jacks having any number of contacts and/or jack ports, although the three conductor format of tip, ring, and sleeve described above is the most common. For example, a two conductor format of tip and sleeve can be used. For jacks having other numbers of contacts and/or jack ports, the number of contacts on the cam 32 may be different than shown herein.

Also, the tip spring contacts 40 and 42, the ring spring contacts 44 and 46, the normalling spring contacts 48, 50, 52, and 54, and the sleeve spring contacts 56 and 58 may be used with a wire wrap pin termination style, a solder lug termination style, a quick connect termination style, etc.

Moreover, as shown and described above, the cam 32 is used to operate the jack 10 to its full normal, half normal, and no normal configurations. However, a switch mechanism other than a cam can be used for this purpose.

Furthermore, the switch that operates the jack to its full normal position, half normal position, and no normal position is described above as a cam operated switch. Instead, other switch forms could be used.

In addition, the cam switch that operates the jack 10 to its full normal position, half normal position, and no normal position is described above as a rotary operated cam switch. Instead, the cam switch could be a linear, non-linear, push/pull, sliding, circumferential, or other type of cam switch.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

We claim:

1. A jack comprising:

a housing supporting first and second jack ports;

a first contact within the housing;

a second contact within the housing; and, a cam operated switch within the housing, wherein the cam operated switch has a full normal position and a half normal position, wherein the cam operated switch, in the full normal position, (i) couples the first and second contacts together when no plug is inserted into either the first jack port or the second jack port and (ii) conditions the jack so that, when a plug is inserted into the first jack port, the coupling between the first and second contacts is broken and the first contact is coupled to the first jack port, and so that, when a plug is inserted into the second jack port, the coupling between the first and second contacts is broken and the second contact is coupled to the second jack port, and wherein the cam operated switch, in the half normal position, (i) couples the first and second contacts together when no plug is inserted into either the first jack port or the second jack port and (ii) conditions the jack so that, when a plug is inserted into the first jack port, the coupling between the first and second contacts is broken and the first contact is coupled to the first jack port, and so that, when a plug is inserted into the second jack port, the coupling between the first and second contacts is maintained and the second contact is coupled to the second jack port.

2. The jack of claim 1 further comprising a third contact engaging the first contact with no plug in the first jack port and disengaging the first contact when a plug is inserted into the first jack port.

3. The jack of claim 1 further comprising a third contact, wherein the first and third contacts engage a plug inserted into the first jack port.

4. The jack of claim 1 further comprising third and fourth contacts, wherein the third contact engages the first contact with no plug in the first jack port and disengages the first contact when a plug is inserted into the first jack port, and wherein the fourth contact engages the second contact with no plug in the second jack port and disengages the second contact when a plug is inserted into the second jack port.

5. The jack of claim 1 further comprising third and fourth contacts, wherein the first and third contacts engage a plug inserted into the first jack port, and wherein the second and fourth contacts engage a plug inserted into the second jack port.

6. The jack of claim 1 further comprising third and fourth contacts, wherein the first and third contacts normally engage one another, wherein the second and fourth contacts normally engage one another, wherein the cam operated switch comprises fifth and sixth contacts and a bridging contact, wherein the third contact engages the fifth contact, wherein the fourth contact engages the sixth contact, and wherein the bridging contact engages the fifth and sixth contacts only when the cam operated switch is in the full normal position.

7. The jack of claim 6 wherein the third contact engages the first contact with no plug in the first jack port and disengages the first contact when a plug is inserted into the first jack port, and wherein the fourth contact engages the second contact with no plug in the second jack port and disengages the second contact when a plug is inserted into the second jack port.

8. The jack of claim 1 further comprising a third contact, wherein the first and third contacts normally engage one another, wherein the cam operated switch comprises fourth and fifth contacts and a bridging contact, wherein the third contact engages the fourth contact, wherein the second contact engages the fifth contact, and wherein the bridging contact engages the fourth and fifth contacts only when the cam operated switch is in the half normal position.

9. The jack of claim 8 wherein the third contact engages the first contact with no plug in the first jack port and disengages the first contact when a plug is inserted into the first jack port.

10. The jack of claim 8 further comprising a sixth contact, wherein the bridging contact comprises a first bridging contact, wherein the second and sixth contacts normally engage one another, wherein the cam operated switch further comprises a seventh contact and a second bridging contact, wherein the sixth contact engages the seventh contact, and wherein the second bridging contact engages the fourth and seventh contacts only when the cam operated switch is in the full normal position.

11. The jack of claim 10 wherein the third contact engages the first contact with no plug in the first jack port and disengages the first contact when a plug is inserted into the first jack port, and wherein the sixth contact engages the second contact with no plug in the second jack port and disengages the second contact when a plug is inserted into the second jack port.

12. The jack of claim 11 wherein the cam operated switch comprises a cam, wherein the first bridging contact comprises a first electrically conductive cam surface, and wherein the second bridging contact comprises a second electrically conductive cam surface.

13. A jack comprising:

a housing supporting first and second jack ports;

a first contact within the housing;

a second contact within the housing; and, a cam operated switch within the housing, the cam operated switch having a full normal position and a no normal position, wherein the cam operated switch, in the full normal position, (i) couples the first and second contacts together when no plug is inserted into either the first jack port or the second jack port and (ii) conditions the jack so that, when a plug is inserted into the first jack port, the coupling between the first and second contacts is broken and the first contact is coupled to the first jack port, and so that, when a plug is inserted into the second jack port, the coupling between the first and second contacts is broken and the second contact is coupled to the second jack port, and wherein the cam operated switch, in the no normal position, (i) provides no coupling between the first and second contacts whether or not a plug is inserted into either the first jack port or the second jack port and (ii) conditions the jack so that, when a plug is inserted into the first jack port, the first contact is coupled to the first jack port, and so that, when a plug is inserted into the second jack port, the second contact is coupled to the second jack port.

14. The jack of claim 13 further comprising a third contact engaging the first contact with no plug in the first jack port and disengaging the first contact when a plug is inserted into the first jack port.

15. The jack of claim 13 further comprising a third contact, wherein the first and third contacts engage a plug inserted into the first jack port.

16. The jack of claim 13 further comprising third and fourth contacts, wherein the third contact engages the first contact with no plug in the first jack port and disengages the first contact when a plug is inserted into the first jack port, and wherein the fourth contact engages the second contact with no plug in the second jack port and disengages the second contact when a plug is inserted into the second jack port.

17. The jack of claim 13 further comprising third and fourth contacts, wherein the first and third contacts engage a plug inserted into the first jack port, and wherein the second and fourth contacts engage a plug inserted into the second jack port.

18. The jack of claim 13 further comprising third and fourth contacts, wherein the first and third contacts normally engage one another, wherein the second and fourth contacts normally engage one another, wherein the cam operated switch comprises fifth and sixth contacts and a bridging contact, wherein the third contact engages the fifth contact, wherein the fourth contact engages the sixth contact, and wherein the bridging contact engages the fifth and sixth contacts only when the cam operated switch is in the full normal position.

19. The jack of claim 18 wherein the third contact engages the first contact with no plug in the first jack port and disengages the first contact when a plug is inserted into the first jack port, and wherein the fourth contact engages the second contact with no plug in the second jack port and disengages the second contact when a plug is inserted into the second jack port.

20. The jack of claim 19 wherein the cam operated switch comprises a cam, and wherein the bridging contact comprises an electrically conductive cam surface.

21. A jack comprising:

a housing supporting first and second jack ports;

a first contact within the housing;

a second contact within the housing; and, a cam operated switch within the housing, the cam operated switch having a half normal position and a no normal position, wherein the cam operated switch, in the half normal position, (i) couples the first and second contacts together when no plug is inserted into either the first jack port or the second jack port and (ii) conditions the jack so that, when a plug is inserted into the first jack port, the coupling between the first and second contacts is broken and the first contact is coupled to the first jack port, and so that, when a plug is inserted into the second jack port, the coupling between the first and second contacts is maintained and the second contact is coupled to the second jack port, and wherein the cam operated switch, in the no normal position, (i) provides no coupling between the first and second contacts whether or not a plug is inserted into either the first jack port or the second jack port and (ii) conditions the jack so that, when a plug is inserted into the first jack port, the first contact is coupled to the first jack port, and so that, when a plug is inserted into the second jack port, the second contact is coupled to the second jack port.

22. The jack of claim 21 further comprising a third contact engaging the first contact with no plug in the first jack port and disengaging the first contact when a plug is inserted into the first jack port.

23. The jack of claim 21 further comprising a third contact, wherein the first and third contacts engage a plug inserted into the first jack port.

24. The jack of claim 21 further comprising third and fourth contacts, wherein the third contact engages the first contact with no plug in the first jack port and disengages the first contact when a plug is inserted into the first jack port, and wherein the fourth contact engages the second contact with no plug in the second jack port and disengages the second contact when a plug is inserted into the second jack port.

25. The jack of claim 21 further comprising third and fourth contacts, wherein the first and third contacts engage a plug inserted into the first jack port, and wherein the second and fourth contacts engage a plug inserted into the second jack port.

26. The jack of claim 21 further comprising a third contact, wherein the first and third contacts normally engage one another, wherein the cam operated switch comprises fourth and fifth contacts and a bridging contact, wherein the third contact engages the fourth contact, wherein the second contact engages the fifth contact, and wherein the bridging contact engages the fourth and fifth contacts only when the cam operated switch is in the half normal position.

27. The jack of claim 26 wherein the third contact engages the first contact with no plug in the first jack port and disengages the first contact when a plug is inserted into the first jack port.

28. The jack of claim 27 wherein the cam operated switch comprises a cam, and wherein the bridging contact comprises an electrically conductive cam surface.

29. A jack comprising:

a housing supporting first and second jack ports;

a first contact within the housing;

a second contact within the housing; and, a cam operated switch within the housing, the cam operated switch having a full normal position, a half normal position, and a no normal position, wherein the cam operated switch, in the full normal position, (i) couples the first and second contacts together when no plug is inserted into either the first jack port or the second jack port and (ii) conditions the jack so that, when a plug is inserted into the first jack port, the coupling between the first and second contacts is broken and the first contact is coupled to the first jack port, and so that, when a plug is inserted into the second jack port, the coupling between the first and second contacts is broken and the second contact is coupled to the second jack port, wherein the cam operated switch, in the half normal position, (i) couples the first and second contacts together when no plug is inserted into either the first jack port or the second jack port and (ii) conditions the jack so that, when a plug is inserted into the first jack port, the coupling between the first and second contacts is broken and the first contact is coupled to the first jack port, and so that, when a plug is inserted into the second jack port, the coupling between the first and second contacts is maintained and the second contact is coupled to the second jack port, and wherein the cam operated switch, in the no normal position, (i) provides no coupling between the first and second contacts whether or not a plug is inserted into either the first jack port or the second jack port and (ii) conditions the jack so that, when a plug is inserted into the first jack port, the first contact is coupled to the first jack port, and so that, when a plug is inserted into the second jack port, the second contact is coupled to the second jack port.

30. The jack of claim 29 further comprising a third contact engaging the first contact with no plug in the first jack port and disengaging the first contact when a plug is inserted into the first jack port.

31. The jack of claim 29 further comprising a third contact, wherein the first and third contacts engage a plug inserted into the first jack port.

32. The jack of claim 29 further comprising third and fourth contacts, wherein the third contact engages the first contact with no plug in the first jack port and disengages the first contact when a plug is inserted into the first jack port, and wherein the fourth contact engages the second contact with no plug in the second jack port and disengages the second contact when a plug is inserted into the second jack port.

33. The jack of claim 29 further comprising third and fourth contacts, wherein the first and third contacts engage a plug inserted into the first jack port, and wherein the second and fourth contacts engage a plug inserted into the second jack port.

34. The jack of claim 29 further comprising third and fourth contacts, wherein the first and third contacts normally engage one another, wherein the second and fourth contacts normally engage one another, wherein the cam operated switch comprises fifth, sixth, and seventh contacts and first and second bridging contacts, wherein the third contact engages the fifth contact, wherein the fourth contact engages the sixth contact, wherein the second contact engages the seventh contact, wherein the first bridging contact engages the fifth and sixth contacts only when the cam operated switch is in the full normal position, wherein the second bridging contact engages the fifth and seventh contacts only when the cam operated switch is in the half normal position, and wherein the first and second bridging contacts do not engage the fifth, sixth, and seventh contacts when the cam operated switch is in the no normal position.

35. The jack of claim 34 wherein the third contact engages the first contact with no plug in the first jack port and disengages the first contact when a plug is inserted into the first jack port, and wherein the fourth contact engages the second contact with no plug in the second jack port and disengages the second contact when a plug is inserted into the second jack port.

36. The jack of claim 35 wherein the cam operated switch comprises a cam, wherein the first bridging contact comprises a first electrically conductive cam surface, and wherein the second bridging contact comprises a second electrically conductive cam surface.

* * * * *